US005348640A

United States Patent [19]

Shimakura et al.

[11] Patent Number: 5,348,640

[45] Date of Patent: Sep. 20, 1994

[54] CHEMICAL CONVERSION METHOD AND AQUEOUS CHEMICAL CONVERSION SOLUTION USED THEREFOR

[75] Inventors: Toshiaki Shimakura, Ichikawa; Yutaka Ishida, Tokyo; Tomomi Watanabe, Kawasaki, all of Japan

[73] Assignee: Nippon Paint Co., Ltd., Osaka, Japan

[21] Appl. No.: 42,628

[22] Filed: Apr. 2, 1993

[30] Foreign Application Priority Data

Apr. 3, 1992 [JP] Japan ..... 4-110729

[51] Int. Cl.[5] ..... C25D 9/08

[52] U.S. Cl. ..... 205/318; 205/106; 205/213; 205/201

[58] Field of Search ..... 205/106, 213, 201, 318

[56] References Cited

FOREIGN PATENT DOCUMENTS 3-111590 5/1991 Japan .
3-202496 9/1991 Japan .
1090743 11/1967 United Kingdom .

OTHER PUBLICATIONS

Cleaning and Etching Aluminum, Metal Finishing, Spring, S., pp. 66–71 (Aug. 1968).

*Primary Examiner*—John Niebling
*Assistant Examiner*—Edna Wong
*Attorney, Agent, or Firm*—Sughrue, Mion, Zinn, Macpeak & Seas

[57] ABSTRACT

The method for forming a chemical conversion film on a substrate made of aluminum or its alloy which comprises the steps of: (a) etching a surface of the substrate with an aqueous solution of acid or alkali; (b) immersing the etched substrate in an aqueous, phosphate-based chemical conversion solution which is substantially free from fluoride ions; and (c) applying a negative voltage to the substrate during at least a part of the immersion step so that a potential of the substrate reaches a predetermined minimum potential which is lower than a natural electrode potential of the substrate in the aqueous chemical conversion solution.

13 Claims, 5 Drawing Sheets

CHEMICAL CONVERSION METHOD AND AQUEOUS CHEMICAL CONVERSION SOLUTION USED THEREFOR

BACKGROUND OF THE INVENTION

The present invention relates to a chemical conversion method for forming a phosphate-based chemical conversion film on a substrate made of aluminum or its alloy and an aqueous chemical conversion solution used therefor. It relates more particularly to a chemical conversion method for forming a dense zinc phosphate film on a surface of a substrate made of aluminum or its alloy by using an aqueous, fluoride-free chemical conversion solution and to the aqueous, fluoride-free chemical conversion solution used in the method.

Recently, substrates made of aluminum or its alloy (hereinafter referred to "aluminum substrate") have been used as parts for automobile bodies due to their lightness. Further, the aluminum substrates are widely used as structural members, various parts of machines, and can members, etc. For the purpose of improving their corrosion resistance, etc., the aluminum substrates are generally subjected to a chemical conversion treatment like steel substrates.

Chemical conversion solutions containing phosphates such as zinc phosphate are generally used to form a chemical conversion film on an aluminum substrate. However, since the aluminum substrate originally has a stable oxide layer on its surface, it has been necessary to dissolve this oxide layer before forming a chemical conversion film on the aluminum substrate. For this purpose, fluoride ions have conventionally been introduced into the conventional chemical conversion solutions. In methods using the conventional chemical conversion solutions, without introducing fluoride ions, a zinc phosphate film cannot be formed on the surface of the aluminum substrate.

According to investigation by the inventors, it has been found that the introduction of fluoride ions causes the following reactions on the aluminum substrate:

(1) The natural electrode potential of the aluminum substrate shifts in the negative (cathodic) direction by a great amount, causing the dissolution of the oxide layer of the aluminum substrate and the etching of the aluminum substrate itself, thereby enabling the deposition of the zinc phosphate on the aluminum substrate; and (2) The corrosion current density of the aluminum substrate in the aqueous chemical conversion solution increases by a great amount. Namely, the fluoride ions etch the surface of the aluminum substrate, whereby a proton reduction reaction (cathodic reaction) is accelerated on the aluminum substrate, thereby increasing a pH value of the aqueous chemical conversion solution around the aluminum substrate, which enables a swift deposition of the zinc phosphate on the aluminum substrate.

However, when the chemical conversion treatment is conducted in the presence of fluoride ions, the resulting zinc phosphate film tends to contain a cryolite ($Na_3AlF_6$). It is known that the cryolite-containing zinc phosphate film shows reduced adhesion to a paint layer which will be formed thereon. In addition, a chemical conversion treatment causing less environmental pollution problems has been recently desired. In this sense, it has been desired to develop a chemical conversion method wherein fluoride ions are not used at all.

In view of the above requirements, there may be proposed a method in which the naturally occurring aluminum oxide layer of the aluminum substrate is dissolved by an acid or an alkali in advance, and then the chemical conversion treatment is conducted using an aqueous, phosphate-based chemical conversion solution which is free from fluoride ions. By this method, however, a new oxide layer is likely to be formed on the aluminum substrate no sooner than it is immersed in the aqueous, phosphate-based chemical conversion solution, thereby preventing the formation of chemical conversion film of zinc phosphate, etc. on the aluminum substrate.

OBJECT AND SUMMARY OF THE INVENTION

Accordingly, an object of the present invention is to provide a chemical conversion method for forming a dense phosphate film on a surface of an aluminum substrate by using an aqueous, fluoride-free phosphate solution.

Another object of the present invention is to provide an aqueous, fluoride-free chemical conversion solution used for such a chemical conversion method.

As a result of intense research in view of the above objects, the inventors have found that by dissolving an oxide layer of an aluminum substrate with an acid or an alkali first, and then immersing the aluminum substrate in an aqueous, phosphate-based chemical conversion solution substantially free from fluoride ions, in which a negative voltage is applied to the aluminum substrate so that the electrode potential of the aluminum substrate shifts in the negative direction to a predetermined minimum, a proton reduction reaction is accelerated on the surface of the aluminum substrate in the aqueous chemical conversion solution due to a cathodic polarization taking place in an interface area between the aluminum substrate and the aqueous chemical conversion solution, thereby proceeding the formation of a good phosphate-based film on the surface of the aluminum substrate. This invention is completed based upon this finding.

Thus, the method for forming a chemical conversion film on a substrate made of aluminum or its alloy according to the present invention comprises the steps of:

(a) etching a surface of the substrate with an aqueous solution of acid or the alkali;

(b) immersing the etched substrate in an aqueous, phosphate-based chemical conversion solution which is substantially free from fluoride ions: and (c) applying a negative voltage to the substrate during at least a part of the immersion step so that a potential of the substrate reaches a predetermined minimum potential which is lower than a natural electrode potential of the substrate in the aqueous chemical conversion solution.

An aqueous chemical conversion solution for forming a chemical conversion film on a substrate made of aluminum or its alloy according to the present invention comprises a phosphate as a main component and is substantially free from fluoride ions, which aqueous solution is used in a chemical conversion method where the substrate is immersed in the aqueous solution and a negative voltage is applied to the substrate during at least a part of the immersion step so that a potential of the substrate reaches a predetermined minimum potential which is lower than a natural electrode potential of the substrate in the aqueous chemical conversion solution.

DETAILED DESCRIPTION OF THE INVENTION

Figure 1:
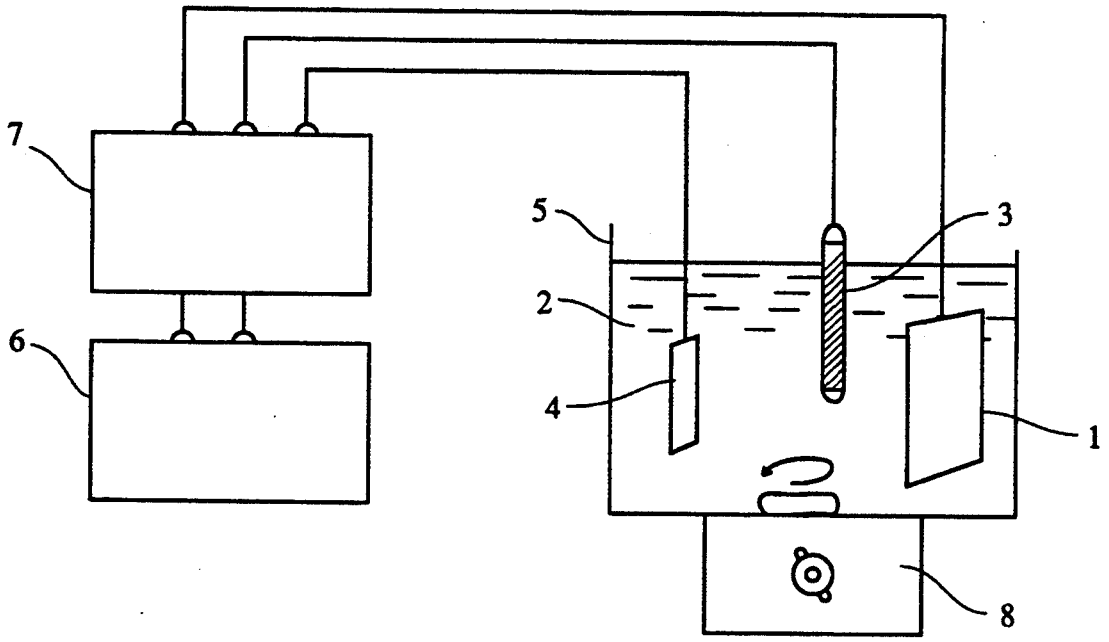
FIG. 1 is a schematic view showing a typical example of an apparatus used in the method of the present invention.

The present invention will be explained in detail below.

1 AUQEOUS CHEMICAL CONVERSION SOLUTION

The term "aqueous chemical conversion solution" used herein means an aqueous solution for forming a protective film (coating) on an aluminum substrate by a surface treatment. The protective film may be called "chemical conversion film (coating)" or simply "chemical film (coating)."

The aqueous chemical conversion solution of the present invention is an aqueous, phosphate-based solution which is substantially free from fluoride ions. These aqueous solutions have, as their main component, at least one monobasic phosphate of a metal selected from the group consisting of Zn, Fe, Mn, Ca, Zr, etc. Among them, a monobasic zinc phosphate is particularly preferable.

The aqueous chemical conversion solution used in the present invention preferably contains 2–30 g/liter of $PO_4$ ions. The aqueous solution may further contain another anion such as $NO_3$ ions or $NO_2$ ions. In these cases, the preferable concentrations of the $NO_3$ ions and the $NO_2$ ions are 0.5–10 g/liter and 0.01–0.1 g/liter, respectively.

The aqueous solution of the above monobasic phosphate may preferably contain, as metal ion components, 0.5–2 g/liter of Zn ions, 0–0.5 g/liter of Fe ions, 0–2 g/liter of Mn ions, 0–2 g/liter of Ca ions and/or 0–2 g/liter of Zr ions. Incidentally, 0–2 g/liter of Ni ions may also be contained as an accelerator.

The sources of Zn ions include zinc oxide, zinc carbonate, zinc nitrate, etc. The sources of Fe ions include ferric chloride, etc. The sources of Mn ions include manganese carbonate, manganese nitrate, manganese chloride, etc. The sources of Ca ions include calcium carbonate, calcium nitrate, calcium chloride, etc. The sources of Zr ions include zirconium carbonate, zirconium nitrate, zirconium chloride, etc. and their oxyzirconium compound. The sources of Ni ions include nickel carbonate, nickel nitrate, nickel chloride, etc.

With respect to the sources of phosphate ions, they may be phosphoric acid, sodium phosphate, zinc phosphate, manganese phosphate, nickel phosphate, ferrous phosphate, etc. The sources of $NO_3$ ions or $NO_2$ ions include $NO_3$ or $NO_2$ salts of the above-mentioned metals.

In addition to the aforementioned metal ions, the aqueous chemical conversion solution may further contain ions of Cr, Cu, Co, Mo, W, Mg, Ti, Si, etc.

In the practical use of the aqueous chemical conversion solution, it is preferable that the aqueous chemical conversion solution is adjusted to have a total acidity of 10–20 points and a free acidity of 0.8–1.2 points. Incidentally, the total acidity is defined as the amount (ml) of a 0.1-N sodium hydroxide aqueous solution consumed to titrate 10 ml of the aqueous chemical conversion solution, which is confirmed with a phenolphthalein indicator, and the free acidity is defined as the amount (ml) of a 0.1-N sodium hydroxide aqueous solution consumed to titrate 10 ml of the aqueous chemical conversion solution, which is confirmed with a bromphenol blue indicator. Both of the total acidity and the free acidity are expressed by points which correspond to the milliliters of the 0.1-N sodium hydroxide aqueous solution consumed. Also, the accelerator value (toner value) is preferably 1.0–4.0.

The aluminum substrates to which the aqueous chemical conversion solution of the present invention can be applied may be made of aluminum or its alloys such as an aluminum-copper alloy, an aluminum-zinc alloy, an aluminum-manganese alloy, an aluminum-magnesium alloy, an aluminum-magnesium-silicon alloy, an aluminum-zinc-magnesium alloy, etc. The chemical conversion solution can also be applied to metal members plated with aluminum.

The aluminum substrate may be in any shape such as a plate, a rod, a wire, a pipe, etc. Aluminum cans as well as aluminum caps of containers for food and beverages may also be treated with the aqueous chemical conversion solution of the present invention.

2 CHEMICAL CONVERSION METHOD

(A) Degreasing Treatment

Before treating an aluminum substrate with acid or the alkali, a degreasing treatment is usually conducted on the aluminum substrate in the method of the present invention. The degreasing treatment may be conducted with a solvent such as trichloroethylene, perchloroethylene, gasoline, n-hexane, etc., or with an alkali solution of sodium hydroxide, sodium carbonate, sodium silicate, sodium phosphate, etc.

(B) Dissolution of Aluminum Oxide Layer

After degreasing, the aluminum substrate is rinsed with water and then treated with an acid or an alkali to dissolve an oxide layer thereof to increase the electrical conductivity of the aluminum substrate.

Specific examples of the acid usable in this treatment include phosphoric acid, sulfuric acid, nitric acid, etc. In view of the easiness of handling and the quality of the finished aluminum substrate, it is preferable to use phosphoric acid. As far as the dissolution of the oxide layer is concerned, better results are obtained in the order of hydrofluoric acid, hydrochloric acid, phosphoric acid, sulfuric acid and nitric acid (hydrofluoric acid: maximum). However, hydrofluoric acid and hydrochloric acid are not suitable for the method of the present invention, because the use of hydrofluoric acid causes fluoride ions to be introduced into the aqueous chemical conversion solution, and the use of a hydrochloric acid tends to generate pitting on the resulting film.

With respect to the concentration and temperature of the aqueous solution of acid, it can be said that the higher the better. Namely, the higher the concentration and temperature of the aqueous solution of acid are, the more effectively the oxide layer of the aluminum substrate is dissolved. The concentration of the acid is preferably more than 2 weight %, more preferably 2–20 weight %. When the concentration is less than 2 weight %, the oxide layer cannot be dissolved effectively from the aluminum substrate. The temperature of the aqueous solution of acid is preferably 5°–70° C. By adjusting the concentration and temperature of the acid solution, the treatment (washing) time of the aluminum substrate can be controlled.

When an aqueous solution of phosphoric acid having a concentration of 20 weight % is used as a treatment solution for the dissolution of the oxide layer, the aluminum substrate may preferably be immersed in the aqueous solution at room temperature for about 5 minutes.

An alkali solution may also be used for the dissolution of the oxide layer in the present invention. Specific examples of such alkali solution include solutions of sodium hydroxide, potassium hydroxide, etc. With respect to the concentration of the alkali solution, it may be 1 weight % or more, more preferably 2–5 weight %.

The dissolution of the oxide layer with the acid or the alkali may be conducted by any method such as an immersion method, a spraying method, etc. Among them, the immersion method is preferable.

Incidentally, when the dissolution of the aluminum oxide layer is conducted with an alkali solution, it may sometimes fail to dissolve magnesium oxide segregated on the surface of the aluminum substrate. In such a case, it is preferable to use an aqueous solution of acid for the dissolution of the oxide layer.

After completing the dissolution of the oxide layer, the aluminum substrate is rinsed with water, and then subjected to a surface conditioning treatment. The solutions usable in this surface conditioning treatment may include an aqueous dispersion of colloidal titanium oxide, etc.

(C) Chemical Conversion Treatment

The aluminum substrate is then immersed in the aqueous, phosphate-based chemical conversion solution, and a negative voltage is applied to the aluminum substrate so that the potential of the aluminum substrate shifts in the negative direction, thereby facilitating the formation of the chemical conversion film on the aluminum substrate. The chemical conversion treatment process will be explained in detail below referring to the attached drawings.

Figure 2:
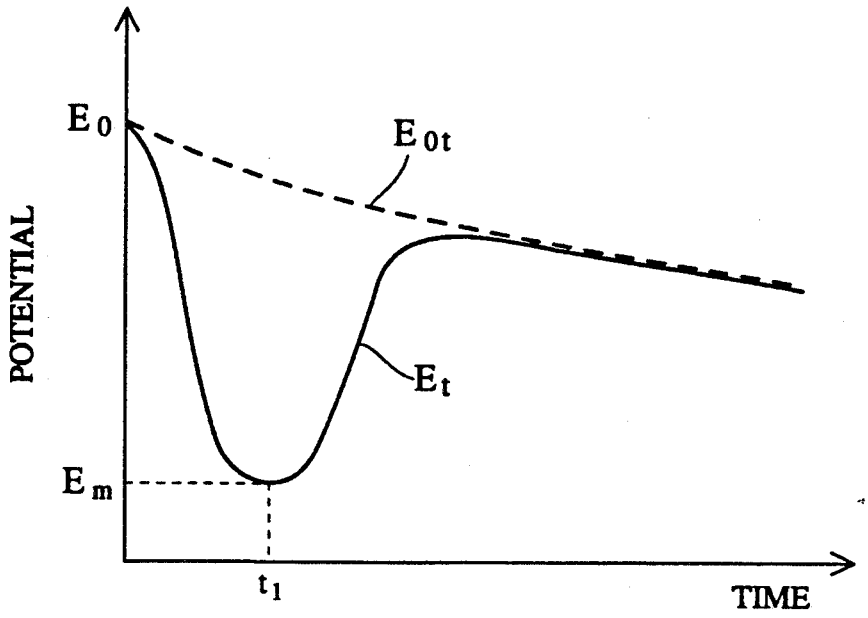
FIG. 2 shows the relation of the natural electrode potential of an aluminum substrate and the potential of the aluminum substrate to which a negative voltage is applied according to the method of the present invention.

FIG. 1 shows a typical example of an apparatus used in the method of the present invention, and FIG. 2 is a graph showing the relation of the natural electrode potential of an aluminum substrate and the potential of the aluminum substrate to which a negative voltage is applied according to the method of the present invention. Referring to FIG. 1, the apparatus comprises a tank 5 filled with an aqueous, phosphate-based chemical conversion solution 2, a reference electrode 3, a positive electrode plate 4, a potentiostat 6, and a function generator 7. An aluminum substrate 1 used as a cathode is immersed in the aqueous, phosphate-based chemical conversion solution 2. The aqueous, phosphate-based chemical conversion solution 2 may preferably be stirred with a magnetic stirrer 8. The aqueous, phosphate-based chemical conversion solution 2 should not necessarily be heated, but its temperature is preferably kept at 30°–70° C. Instead of the potentiostat 6, a direct-current power supply or an alternating-current power supply can be used to apply a negative voltage to the aluminum substrate 1.

While immersing the aluminum substrate 1 in the aqueous, phosphate-based chemical conversion solution 2, a negative voltage is applied to the aluminum substrate 1 by using the potentiostat 6 and the function generator 7, so that the potential of the aluminum substrate 1 shifts in the negative direction, for example, as shown in FIG. 2. In a graph shown in FIG. 2, the horizontal axis indicates the time (unit: second) which has passed since the aluminum substrate 1 is immersed in the aqueous, phosphate-based chemical conversion solution 2, and the vertical axis indicates a potential of the aluminum substrate 1 relative to the reference electrode 3. Incidentally, $E_0$ is an initial natural electrode potential of the aluminum substrate 1, which is measured just at the time of immersing the aluminum substrate 1, and $E_{0t}$ is the natural electrode potential of the aluminum substrate 1 at a time when a certain period of time "t" has passed, which is measured without applying a negative voltage. $E_t$ is the potential of the aluminum substrate 1 when a negative voltage $V_t$ is applied. Thus, $E_t = E_{0t} + V_t$.

Referring to FIG. 2, a negative voltage $V_t$ is applied to the aluminum substrate 1 so that the potential of the aluminum substrate 1 shifts in the negative direction at an early stage of immersion along a smooth curve. In this case, once the potential of the aluminum substrate 1 reaches a predetermined minimum potential $E_m$, the intensity of the voltage $V_t$ applied is gradually reduced to zero so that the potential of the aluminum substrate 1 finally comes back to the natural electrode potential thereof. The potential of the aluminum substrate 1 may be left unchanged during the remaining part of the immersion process. The potential pattern is not restricted to the example shown in FIG. 2, and various potential patterns, which will be described below, can be used in the method of the present invention.

Since a negative voltage $V_t$ is applied to the aluminum substrate 1 while it is immersed in the aqueous, phosphate-based chemical conversion solution 2 in the present invention, the potential of the aluminum substrate 1 changes in the negative direction to reach a predetermined minimum potential $E_m$, which is preferably within the range of:

$$E_0 - 1.5V \leqq E_m \leqq E_0 - 0.8V,$$

more preferably $$E_0 - 1.3V \leqq E_m \leqq E_0 - 1.0V,$$

and most preferably $$E_0 - 1.2V \leqq E_m \leqq E_0 - 1.1V,$$

wherein $E_0$ is the initial natural electrode potential of the aluminum substrate 1 and $E_m$ is a predetermined minimum potential.

Incidentally, the initial natural electrode potential $E_0$ and the predetermined minimum potential $E_m$ are determined relative to the Ag/AgCl reference electrode.

When the $E_m$ is lower than $E_0-1.5V$, a proton reduction reaction takes place excessively, thereby making the pH value of the aqueous, phosphate-based chemical conversion solution 2 unnecessarily high around the aluminum substrate 1. Further, too much hydrogen gas is generated around the aluminum substrate 1, thereby preventing the deposition of zinc phosphate crystals on the surface of the aluminum substrate 1. In this case, even if the chemical conversion film is formed on the aluminum substrate 1, the film contains products other than Hopetite, such as zinc hydroxide, etc., thereby making the properties of the film poor.

On the other hand, when the $E_m$ is higher than $E_0-0.8$ V, a sufficient proton reduction reaction does not take place. As a result, the pH value of the aqueous, phosphate-based chemical conversion solution 2 around the aluminum substrate 1 is not increased enough to make the zinc phosphate crystals deposit on the surface of the aluminum substrate 1.

A negative voltage $V_t$ is applied to the aluminum substrate 1 in such a manner that the potential of the aluminum substrate 1 reaches the predetermined minimum potential $E_m$ at a time $t_1$ which is preferably within 40 seconds, more preferably within 20 seconds after the aluminum substrate 1 starts to be immersed in the aqueous, phosphate-based chemical conversion solution 2.

The potential of the aluminum substrate 1 is kept at a predetermined minimum potential $E_m$ at least for some period of time in the method of the present invention. The reason why this is necessary for the chemical conversion treatment of the present invention will be explained in detail below.

Figure 3:
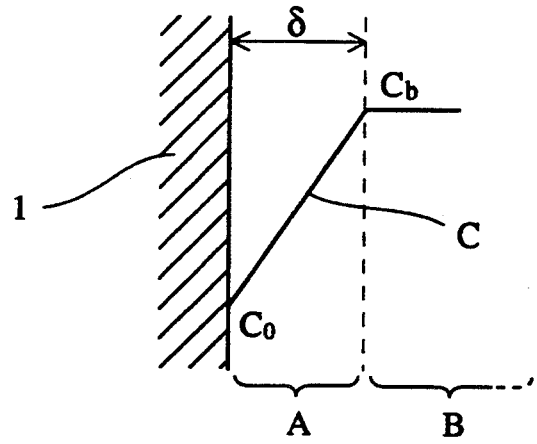
FIG. 3 is a schematic view showing the profile of a proton concentration in the neighborhood of the aluminum substrate surface.

In the present invention, a cathode current density "i" is supplied to the aluminum substrate 1 to increase the pH value of the aqueous, phosphate-based chemical conversion solution 2 around the aluminum substrate 1, thereby enabling the formation of a zinc phosphate film on the aluminum substrate 1. Referring to FIG. 3, the pH value of the aqueous, phosphate-based chemical conversion solution 2 around the aluminum substrate 1 can be estimated from the cathode current density "i". As shown by the proton concentration C in FIG. 3, the aqueous, phosphate-based chemical conversion solution 2 is constituted by an interface area A, namely a proton-diffusion area, around the aluminum substrate 1, in which the proton concentration is changed from $C_0$ to $C_b$, and an ordinary area B, namely a bulk solution area, in which the proton concentration is not changed at $C_b$. Here, the cathode current density "i" is represented by the following general formula:

$$i=nFD(Cb-Co)/\delta \quad (1)$$

wherein n represents the number of electrons, F represents a faraday constant, D represents a diffusion constant of protons, Cb represents a bulk concentration of protons, $C_0$ represents a proton concentration at the interface between the aluminum substrate 1 and the aqueous, phosphate-based chemical conversion solution 2, and $\delta$ represents a width of the proton diffusion area A.

From the above formula (1), the proton concentration $C_0$ at the interface can be calculated as follows:

$$C_0=Cb-i\delta/nFD. \quad (2)$$

The pH value of the aqueous, phosphate-based chemical conversion solution 2 at the interface with the aluminum substrate 1, which is called simply as "interface pH," is represented by the general formula:

$$\text{Interface pH}=-\log(Cb-i\delta/nFD). \quad (3)$$

Figure 4:
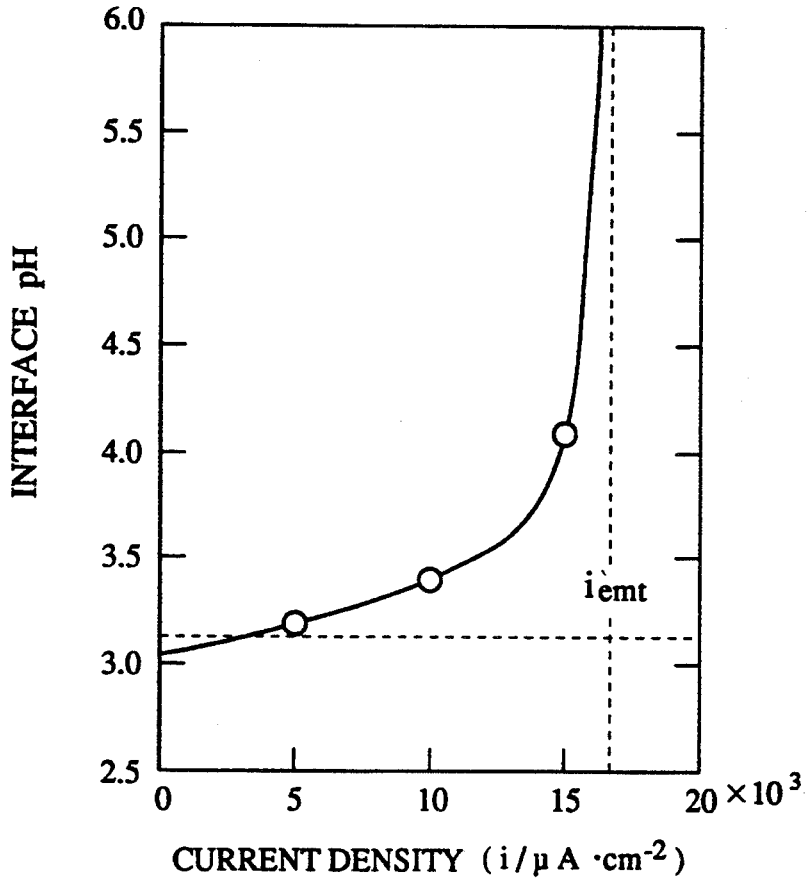
FIG. 4 shows the relation between current density and a pH value in the interface area between the aluminum substrate and the aqueous chemical conversion solution.
Figure 5A:
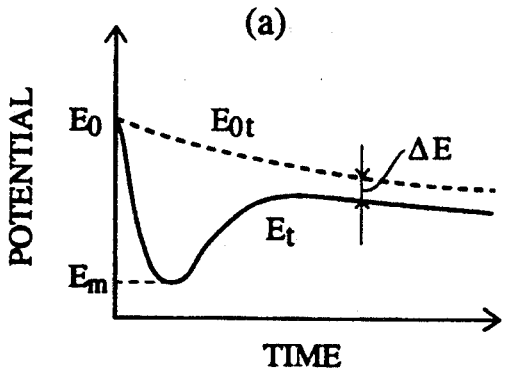
FIGS. 5 (*a*)–(*i*) respectively show different potential patterns of the aluminum substrate usable in the method of the present invention.
Figure 5B:
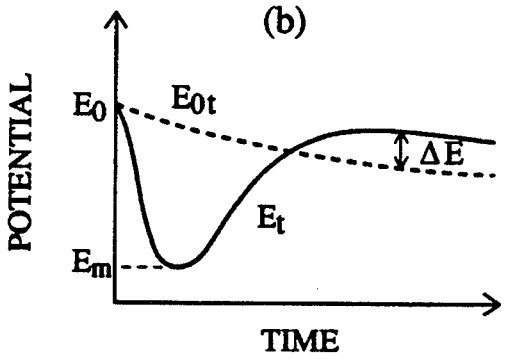
Figure 5C:
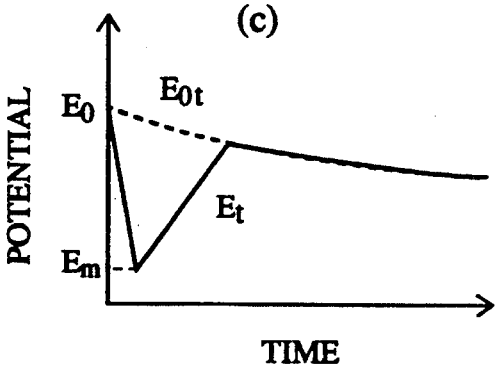
Figure 5D:
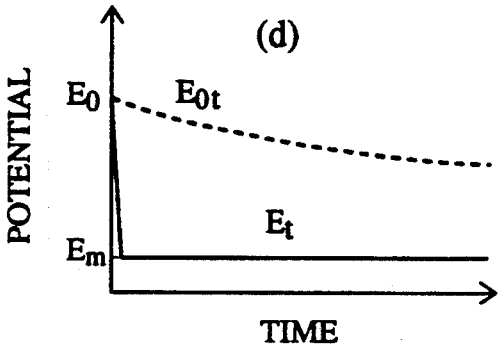
Figure 5E:
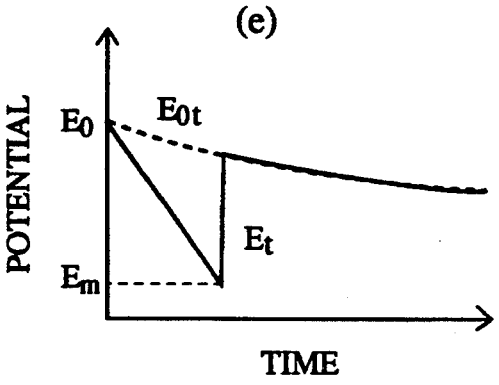
Figure 5F:
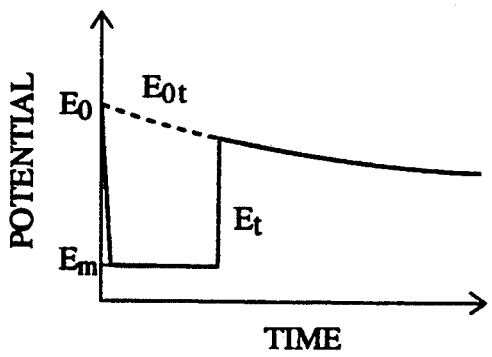
Figure 5G:
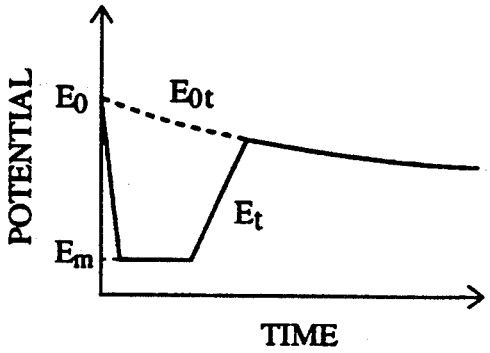
Figure 5H:
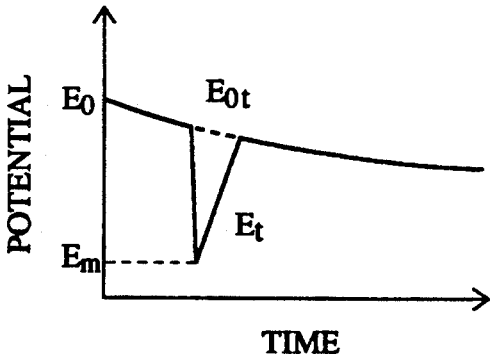
Figure 5I:
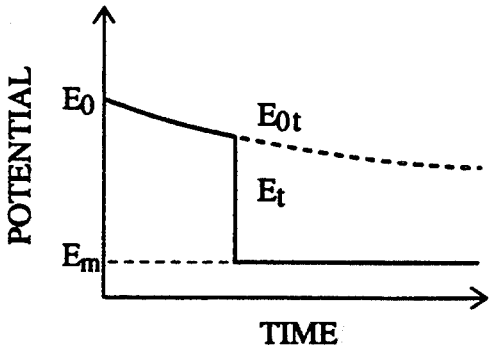
Figure 6A:
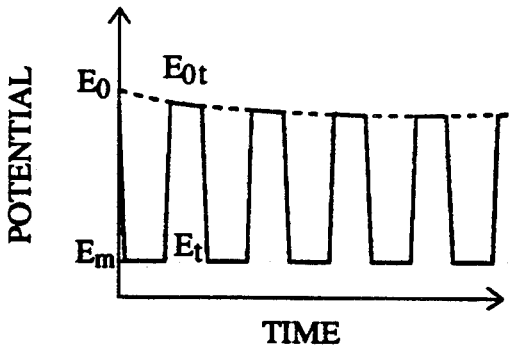
FIGS. 6 (*a*)–(*g*) respectively show different potential patterns of the aluminum substrate usable in the method of the present invention.
Figure 6B:
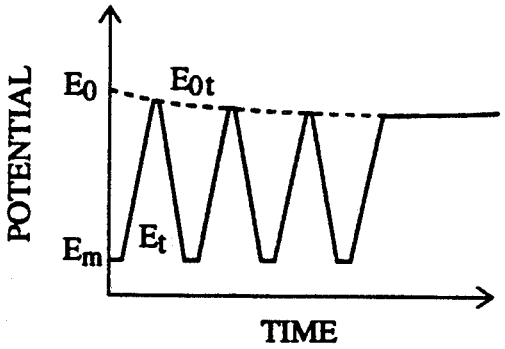
Figure 6C:
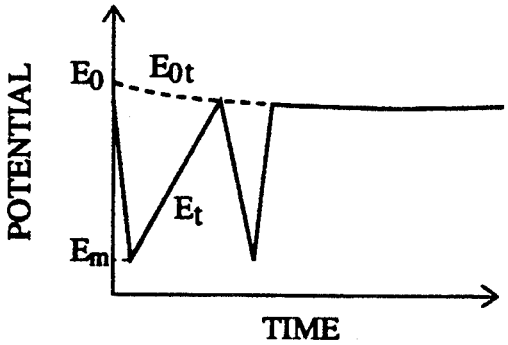
Figure 6D:
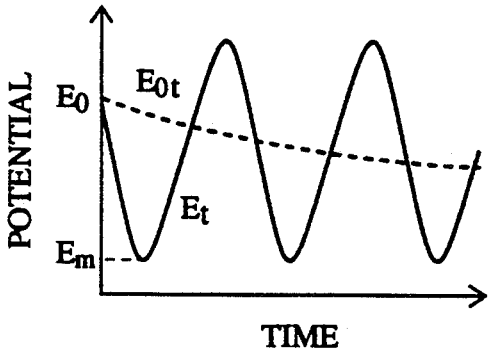
Figure 6E:
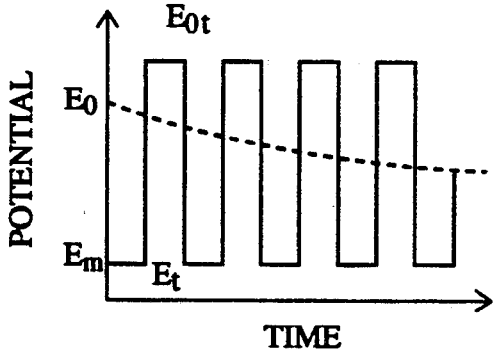
Figure 6F:
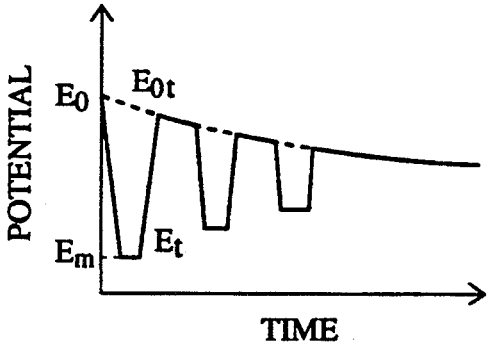
Figure 6G:
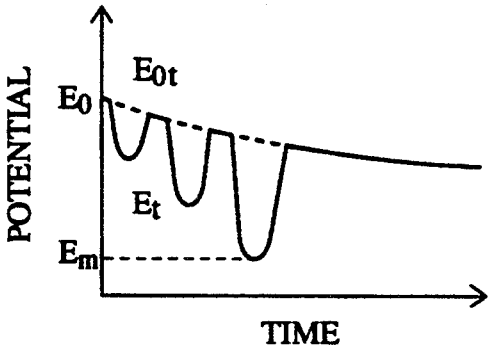

Here, assuming that Cb (corresponding to pH of the aqueous chemical conversion solution 2) is $10^{-3.05}$M, $\delta$ is $10^{-3}$cm, and D is $9.5\times10^{-5}$cm$^2$/sec, the relation of the interface pH and the cathode current density "i" is shown in FIG. 4. As seen in FIG. 4, the interface pH sharply increases as it comes near the limiting current density ($i_{lmt}$), which is 16340 $\mu$A cm$^{-2}$ under the above condition.

Zinc phosphate is deposited on the aluminum substrate at a pH value of about 3.1 under an ordinary condition (zinc phosphate concentration: 20 weight %, and temperature: 20° C.). However, after the pH value of the aqueous chemical conversion solution has increased to about 7.2, zinc hydroxide starts to be deposited on the aluminum substrate. Accordingly, the interface pH value should be set within the range of 3.1–7.2 to form a good chemical conversion film on the aluminum substrate. The preferred interface pH value is in the range of 3.1–4.5. For this reason, the cathode current density "i" (potential) applied to the aluminum substrate and accordingly the minimum potential $E_m$ of the aluminum substrate are set within the aforementioned ranges in the method of the present invention.

In addition to the pattern shown in FIG. 2, various potential patterns as shown in FIGS. 5 (*a*)–(*c*) are applicable in the method of the present invention.

FIG. 5 (*a*) shows a potential variation pattern of the aluminum substrate. In this case, a negative voltage $V_t$ is applied to the aluminum substrate in the same manner as in FIG. 2 except that the negative voltage $V_t$ does not become zero so that the potential of the aluminum substrate is maintained slightly lower than the natural electrode potential $E_{0t}$ by $\Delta E$ after it nears the natural electrode potential $E_{0t}$.

FIG. 5 (*b*) which is outside the scope of the presently claimed invention, shows another potential variation pattern of the aluminum substrate. In this case, a negative voltage $V_t$ is applied to the aluminum substrate in the same manner as in FIG. 2 except that a positive voltage is applied to the aluminum substrate after the potential of the aluminum substrate reaches the natural electrode potential $E_{0t}$ so that the potential of the aluminum substrate is slightly higher than the natural electrode potential $E_{0t}$ by $\Delta E$.

FIG. 5 (*c*) shows a further potential variation pattern of the aluminum substrate. In this case, a negative voltage $V_t$ is applied to the aluminum substrate in the same manner as in FIG. 2 except that the potential of the aluminum substrate changes sharply before and after reaching the predetermined minimum potential $E_m$.

Furthermore, the potential variation patterns of the aluminum substrate shown in FIGS. 5 (*d*)–(*i*) are applicable as well as those shown in FIGS. (*a*)–(*c*) in the method of the present invention.

FIGS. 6 (*a*)–(*g*) of which FIGS. 6(*d*) and (*e*) are outside the scope of the presently claimed invention, show alternating potential variation patterns of the aluminum substrate. In these cases, a negative voltage $V_t$ is applied to the aluminum substrate in an alternating or pulse manner so that the aluminum substrate can experience the predetermined minimum potential $E_m$ at least once, in most cases, several times. Incidentally, the pulse width or the alternating frequency is not particularly limited. The alternating potential variation patterns need not necessarily be in a triangular or rectangular pulse shape. They may also be in a shape of an exponentially decreasing curve, a sinusoidal curve, etc. as long as it reaches the predetermined minimum potential $E_m$ at least once. A stepwise potential variation pattern is also applicable. Further, potential variation patterns obtained by combining two or more potential variation patterns shown in FIGS. 5 and 6 can also be used in the method of the present invention.

In the method of the present invention, a negative voltage $V_t$ is applied to the aluminum substrate so that the potential of the aluminum substrate reaches the predetermined minimum potential $E_m$ at least once. The shorter a period until the potential of the aluminum substrate reaches the predetermined minimum potential $E_m$ during the immersion process, the more zinc phosphate crystal nuclei are deposited on the surface of the aluminum substrate, thereby forming a denser chemical conversion film. Accordingly, the application of voltage $V_t$ is preferably conducted as immediately as possible after the immersion of the aluminum substrate in the aqueous chemical conversion solution to form a good chemical conversion film.

The immersion period during which the negative voltage $V_t$ is applied to the aluminum substrate is preferably 15–300 seconds, more preferably 60–120 seconds.

After completing the chemical conversion treatment, the aluminum substrate is rinsed with water and dried at 90° C. for about 10 minutes.

A paint film can be coated on the resulting chemical conversion film of the aluminum substrate. Specific examples of the paint which can be applied onto the chemical conversion film include thermoset resin paints such as melamine alkyd resin paints, acrylic melamine resin paints, cationic electrodeposition paints such as epoxy resins, etc., and thermoplastic resin paints such as acrylic lacquer, etc.

The present invention will be explained in further detail by way of the following Examples without intention of restricting the scope of the claims.

In Examples, Comparative Examples and Reference examples, the following potential variation patterns and materials of the aluminum substrate were used.

Potential Variation Patterns

A voltage $V_t$ was applied to each aluminum substrate in such a manner that the potential of the aluminum substrate changed in the following patterns:

(1) The potential dropped to a predetermined minimum potential $E_m$ quickly after the immersion and was kept at the level of the predetermined minimum potential $E_m$ as seen in FIG. 5 (*d*).

(2) The potential dropped to a predetermined minimum potential $E_m$ quickly after the immersion, and then varied in a rectangular pulse manner between the predetermined minimum potential $E_m$ and the natural electrode potential $E_{0t}$ (pulse width: 10 seconds at both $E_m$ and $E_{0t}$) as seen in FIG. 6 (*a*).

(3) The potential dropped to a predetermined minimum potential $E_m$ quickly after the immersion, kept at the minimum potential $E_m$ for about 30 seconds, and then returned to the natural electrode potential $E_{0t}$ as seen in FIG. 5 (*f*).

(4) No voltage $V_t$ was applied to the aluminum substrate so that the potential of the aluminum substrate remained at the natural electrode potential $E_{0t}$ throughout the immersion process.

(5) The potential of the aluminum substrate was changed to 0.5 V higher than the natural electrode potential $E_{0t}$ immediately after the immersion, kept at $E_{0t}$ for about 30 seconds, and then fell to the natural electrode potential $E_{0t}$.

Predetermined Minimum Potential ($E_m$)

The predetermined minimum potential $E_m$ of each aluminum substrate was set at a level which was lower than the initial natural electrode potential $E_0$ by 1.5 V, 1.3 V, 1.2 V, 1.1 V, 1.0 V, and 0.8 V, respectively, except for Comparative Example 3 in which the potential of the aluminum substrate was increased to 0.5 V higher than the initial natural electrode potential $E_0$ (reference electrode: Ag/AgCl).

Materials of Aluminum Substrate

Each aluminum substrate of 70 mm×10 mm×0.8 mm was made of the following material:

A: Aluminum Type 5000 (Al/Mg/Cu), or

B: Aluminum Type 6000 (Al/Mg/Cu/Si).

EXAMPLES 1–22, COMPARATIVE EXAMPLES 1–3, REFERENCE EXAMPLES 1 and 2

Each aluminum substrate was subjected to the following treatments:

(1) Degreasing

Alkali degreasing was conducted on each sample of the aluminum substrate with an alkali degreasing agent (Surfcleaner 53® available from Nippon Paint Co., Ltd.) at 45° C. for 2 minutes.

(2) Dissolution of Aluminum Oxide Layer

Each sample was then subjected to one of the following oxide layer-dissolution treatments:

(i) The sample was immersed in a phosphoric acid solution (concentration: 20 weight %) at 20° C. for 5 minutes.

(ii) The sample was immersed in a sulfuric acid solution (concentration: 5 weight %) at 20° C. for 10 minutes.

(iii) The sample was immersed in an aqueous solution of sodium hydroxide (concentration: 5 weight %) at 20° C. for 5 minutes.

(3) Rinsing

Each sample was then rinsed with a tap water at room temperature for about 15 seconds.

(4) Surface Conditioning Treatment

After the rinsing, each sample was subjected to a surface conditioning treatment with Surffine 5N-10® available from Nippon Paint Co., Ltd.) at 20° C. for 20 seconds.

(5) Chemical Conversion Treatment

The following aqueous phosphate-based chemical conversion solutions were prepared for treating each sample.

Solution 1

An aqueous, phosphate-based chemical conversion solution substantially free from fluoride ions and containing 800 ppm of Zn ions, 15000 ppm of $PO_4$ ions, and 5000 ppm of $NO_3$ ions.

Solution 2

An aqueous solution having the same composition as the solution 1 except for further containing 1000 ppm of Ni ions.

Solution 3

An aqueous solution having essentially the same composition as the solution 1 except for further containing 500 ppm of F ions.

Solution 4

An aqueous solution having essentially the same composition as the solution 1 except for further containing 500 ppm of F ions and 1000 ppm of Ni ions. The total acidities, free acidities and accelerator values of the above four solutions are shown in Table 1.

TABLE 1

| | Total Acidity | Free Acidity | Accelerator Value |
|---|---|---|---|
| Solution 1 | 20 | 0.85 | 2.5 |
| Solution 2 | 21 | 0.85 | 2.5 |
| Solution 3 | 22 | 0.85 | 2.5 |
| Solution 4 | 22 | 0.85 | 2.5 |

In Examples 1–22, Comparative Examples 1–3 and Reference Examples 1 and 2, the aluminum substrate was subjected to the chemical conversion treatment shown in Tables 2 and 3.

TABLE 2

| No. | Type of Sample | Oxide-Layer Dissolution | Treatment Solution | Potential Pattern | $E_m$ (V) |
|---|---|---|---|---|---|
| Example 1 | A | (i) | (1) | (1) | −1.1 |
| Example 2 | A | (i) | (1) | (1) | −1.2 |
| Example 3 | A | (i) | (1) | (1) | −0.8 |
| Example 4 | A | (i) | (1) | (1) | −1.0 |
| Example 5 | A | (i) | (1) | (1) | −1.5 |
| Example 6 | A | (i) | (1) | (1) | −1.3 |
| Example 7 | A | (i) | (1) | (2) | −1.1 |
| Example 8 | A | (i) | (1) | (2) | −1.2 |
| Example 9 | A | (i) | (1) | (3) | −1.1 |
| Example 10 | A | (i) | (1) | (3) | −1.2 |
| Example 11 | A | (i) | (2) | (1) | −1.1 |
| Example 12 | A | (i) | (2) | (1) | −1.2 |
| Example 13 | A | (i) | (2) | (1) | −1.0 |
| Example 14 | A | (i) | (2) | (1) | −1.3 |
| Example 15 | A | (ii) | (1) | (1) | −1.1 |
| Example 16 | A | (ii) | (2) | (2) | −1.2 |
| Example 17 | A | (iii) | (1) | (2) | −1.2 |
| Example 18 | A | (iii) | (2) | (1) | −1.1 |
| Example 19 | B | (i) | (1) | (1) | −1.1 |
| Example 20 | B | (i) | (2) | (2) | −1.2 |
| Example 21 | B | (ii) | (1) | (2) | −1.2 |
| Example 22 | B | (ii) | (2) | (1) | −1.1 |

TABLE 3

| No. | Type of Sample | Oxide-Layer Dissolution | Treatment Solution | Potential Pattern | $E_m$ (V) |
|---|---|---|---|---|---|
| Com. Ex. 1 | A | — | (1) | (1) | −1.1 |
| Com. Ex. 2 | A | (i) | (1) | — | — |
| Com. Ex. 3 | A | (i) | (1) | (5) | +0.5 |
| Ref. Ex. 1 | A | (i) | (3) | (1) | −1.1 |
| Ref. Ex. 2 | B | (i) | (4) | (2) | −1.2 |

1 Diameter of Crystals in the Resulting Chemical Conversion Film

With respect to the chemical conversion film formed on the surface of each sample, the diameter of crystals constituting the chemical conversion film was measured by a scanning-type electron microscope.

2 Corrosion Resistance Test

Each chemical conversion film was subjected to a salt spray test (SST, according to JIS Z 2371) to evaluated a corrosion resistance thereof. Specifically, after spraying salt water, the sample was left for 60 minutes and the sample was observed with respect to rust by the naked eye. The results were classified depending on a rust area (R) of the sample surface into the following categories:

◎: R=0%;
○+: 0%<R≦0.1%;
○: 0.1%<R≦0.2%;
○−: 0.2%<R≦0.5%;
Δ: 0.5%<R<1%; and
×: 1%≦R.

3 Adhesion Test

A cationic electrodeposition paint (Powertop U-600 ® available from Nippon Paint Co., Ltd.) was applied onto the chemical film of each sample in a thickness of 25–30 μm by applying a negative voltage of 180 V for 3 minutes. Each of the painted samples was then baked at 175° C. for 20 minutes.

Each of the samples was tested with respect to the adhesion between the paint and the chemical film. The test procedure and the evaluation standards of test results were as follows:

Each sample provided with a cut line on the surface was immersed in a salt water having a concentration of 5% at 50° C. for 600 hours. An adhesive tape was adhered to the cut surface of the sample and peeled off to measure the width (W) of the chemical film removed from the sample. The results were evaluated according to the following standards:

◎: W<0.5 mm;
○+: 0.5 mm≦W<1.0 mm;
○: 1.0 mm≦W<1.5 mm;
Δ: 1.5 mm≦W<2.0 mm; and
×: 2.0 mm≦W.

The results of the above tests are shown in Tables 4 and 5 below.

TABLE 4

| No. | Diameter of Crystals (μm) | Corrosion Resistance of Film | Adhesion of Film to Paint |
|---|---|---|---|
| Example 1 | 5–7 | ◎ | ◎ |
| Example 2 | 5–10 | ◎ | ◎ |
| Example 3 | 10–15 | ○+ | ○+ |
| Example 4 | 10–15 | ○ | ○ |
| Example 5 | 15–20 | ○− | ○ |
| Example 6 | 10–15 | ○ | ○ |
| Example 7 | 7–10 | ○ | ○ |
| Example 8 | 7–10 | ○ | ○ |
| Example 9 | 15–20 | ○− | ○ |
| Example 10 | 15–20 | ○− | ○ |
| Example 11 | R≦5 | ◎ | ◎ |
| Example 12 | R≦5 | ◎ | ◎ |
| Example 13 | 5–7 | ○ | ○ |
| Example 14 | 5–7 | ○ | ○ |
| Example 15 | R≦10 | ○ | ○ |
| Example 16 | 7–10 | ○ | ○ |
| Example 17 | 15–20 | ○− | ○ |
| Example 18 | 13–15 | ○ | ○ |
| Example 19 | 7–10 | ○ | ○ |
| Example 20 | 7–10 | ○ | ○ |

TABLE 4-continued

| No. | Diameter of Crystals (μm) | Corrosion Resistance of Film | Adhesion of Film to Paint |
|---|---|---|---|
| Example 21 | 10–15 | ○ | ○ |
| Example 22 | R≦10 | ○ | ○ |

TABLE 5

| No. | Diameter of Castals (μm) | Corrosion Resistance of Film | Adhesion of Film to Paint |
|---|---|---|---|
| Com. Ex. 1 | 20–50 | X | X |
| Com. Ex. 2 | 20–50 | X | X |
| Com. Ex. 3 | 20–50 | X | X |
| Ref Ex. 1 | 5–7 | ◎ | ◎ |
| Ref Ex. 2 | 5–7 | ◎ | ◎ |

As described above in detail, the chemical conversion films formed on aluminum substrates by the method of the present invention, in which the aqueous, phosphate-based chemical conversion solution substantially free from fluoride ions is used and the potentials of aluminum substrates are controlled, show as good properties as those of films attained by using phosphate-based chemical conversion solutions containing fluoride ions. The formation of such chemical conversion films in the absence of fluoride ions has been considered impossible heretofore.

Also, since an aluminum substrate is used as a cathode in the method of the present invention, the aluminum ions, which would prevent the formation of a chemical conversion film on an aluminum substrate, do not dissolve into the aqueous chemical conversion solution.

Further, since the aqueous chemical conversion solution used in the method of the present invention is substantially free from fluoride ions, the chemical conversion film formed on an aluminum substrate does not contain cryolite, thereby having excellent properties.

The method of the present invention is widely applicable to various aluminum substrates for automobile bodies, structural members, various parts of machines, cans, etc.

The present invention has been described by Examples, but it should be noted that any modifications are possible unless they deviate from the scope of the present invention defined by the claims attached hereto.

What is claimed is:

1. A method for forming a chemical conversion coating on a member made of aluminum or its alloy comprising the steps of:

(a) etching a surface of said member with an aqueous solution of acid or alkali;

(b) immersing the etched member in a phosphate-based chemical conversion treatment solution which is substantially free from fluoride ions; and (c) applying a negative voltage, $V_t$, to said member during at least a part of said immersion step, so that the potential, $E_t$, of said member defined by the formula: $E_t = E_{0t} + V_t$ reaches a minimum potential, $E_m$, satisfying the following formula:

$$E_0 - 1.5V \leqq E_m \leqq E_0 - 0.8V,$$

wherein $E_0$ represents an initial value of said natural electrode potential of said member, and $E_{0t}$ is said natural electrode potential of said member at a time when a certain period of time, "t", has passed.

2. The method according to claim 1, wherein said negative voltage is applied to said substrate immediately after immersing said substrate into said aqueous chemical conversion solution.

3. The method according to claim 1, wherein said negative voltage is applied to said substrate so that said potential of said substrate reaches said predetermined minimum potential, and then the application of said negative voltage is ceased so that said potential of said substrate comes back to said natural electrode potential.

4. The method according to claim 1, wherein said negative voltage is applied to said substrate so that said potential of said substrate reaches said predetermined minimum potential, and then said negative voltage is gradually reduced to zero.

5. The method according to claim 1, wherein said predetermined minimum potential $E_m$, is within the range of $E_0 - 1.3V \leqq E_m \leqq E_0 - 1.0V$.

6. The method according to claim 1, wherein said predetermined minimum potential $E_m$, is within the range of $E_0 - 1.2V \leqq E_m \leqq E_0 - 1.1V$.

7. The method according to claim 1, wherein said negative voltage is applied to said substrate all through said immersion step.

8. The method according to claim 1, wherein said etching of said surface of said substrate is conducted with an acid.

9. A chemical conversion coating prepared by a process comprising the steps of:

immersing a member made of aluminum or its alloy in a solution of a composition comprising a phosphate as a main component and being substantially free from fluoride ions, and applying a negative voltage, $V_t$, to said member during at least a part of said immersion step, so that a potential, $E_t$, of said member defined by the formula: $E_t = E_{0t} + V_t$ reaches a minimum potential, $E_m$, satisfying the following formula:

$$E_0 - 1.5V \leqq E_m \leqq E_0 - 0.8V,$$

wherein $E_0$ represents an initial value of said natural electrode potential of said member, and $E_{0t}$ is said natural electrode potential of said member at a time when a certain period of time "t" has passed.

10. The method according to claim 1, wherein said phosphate-based chemical conversion treatment solution has as a main component at least one phosphate of a metal selected from the group consisting of Zn, Fe, Mn, Ca and Zr.

11. The method according to claim 10, wherein said metal is Zn.

12. The chemical conversion coating according to claim 9, wherein said phosphate is at least one phosphate of a metal selected from the group consisting of Zn, Fe, Mn, Ca and Zr.

13. The chemical conversion coating according to claim 12, wherein said metal is Zn.

* * * * *